United States Patent [19]

Love et al.

[11] Patent Number: 4,637,151

[45] Date of Patent: Jan. 20, 1987

[54] COMBINATION STADIUM CUSHION AND PENNANT

[76] Inventors: Samuel D. Love, 13510 Old Indian Head Rd., Brandywine, Md. 20613; Mialan V. Love, 10145 Scotch Hill Dr., Upper Marlboro, Md. 20745

[21] Appl. No.: 780,637

[22] Filed: Sep. 26, 1985

[51] Int. Cl.[4] ..... G09F 7/00

[52] U.S. Cl. ..... 40/584; 40/10 R; 40/586

[58] Field of Search ..... 40/584, 159, 320, 10 D, 40/10 R, 586; 5/437, 440, 462; D6/597, 599

[56] References Cited

U.S. PATENT DOCUMENTS

| | | | |
|---|---|---|---|
| 1,682,047 | 8/1928 | Lang et al. | 40/320 |
| 2,792,055 | 5/1957 | O'Neil | 5/462 |
| 3,686,782 | 8/1972 | Erickson et al. | 40/152 |
| 4,190,918 | 3/1980 | Harvell | 5/465 |
| 4,441,271 | 4/1984 | Hutchinson | 40/584 |

*Primary Examiner*—Robert P. Swiatek
*Assistant Examiner*—Cary E. Stone
*Attorney, Agent, or Firm*—Parkhurst & Oliff

[57] ABSTRACT

A combination portable stadium cushion and pennant includes a seat cushion made of a block of foam material or the like, enclosed within an outer cushion cover, an inverted U-shaped member attached to a top part of the seat cushion and having a plurality of pockets formed in side walls thereof. The U-shaped member is made of a transparent plastic material and has openings into the pockets at the top edges thereof. The cushion may be used as a pennant by inserting bumper-stickers or the like displaying information about a team into the pockets. In another embodiment, the cushioned seat has a rectangularly shaped extendible member slidable in and out of a cavity in the cushion. The inverted U-shaped member then is placed on the extendible member.

7 Claims, 3 Drawing Figures

COMBINATION STADIUM CUSHION AND PENNANT

BACKGROUND OF THE INVENTION

This invention relates to the field of portable stadium seat cushions which can be carried or worn by an individual and also serve additional purposes.

Portable cushions commonly are used to make bleachers, benches and hard frame seats more comfortable. This especially is true with sport fans attending outdoor sporting events such as football games and racing events. For outdoor sport events, especially when attending a sport event at a stadium, it often is desirable to carry articles such as gloves, flags and other paraphernalia for cheering purposes. In carrying a conventional cushion assembly, along with all of the other desired articles, one often finds that it is inconvenient, burdensome, and even becomes a substantial chore just to carry everything to the desired destination. It therefore is desirable to provide multiple purpose articles, thereby reducing the number of articles to be carried.

Prior dual-purpose or portable devices have included: a combination portable seat cushion and pennant which includes two cushions to use as pennants and noise makers (see U.S. Pat. No. 4,441,271—Hutchinson); a spectator's seat with backrest which includes a backrest assembly, a pocket on one side to transport parts needed to assemble the seat, and designed to be carried like a briefcase (see U.S. Pat. No. 2,707,513—Lake); a combination folding cushion and carrying assembly including a pocket to carry articles such as toothpaste, combs, containers, and cosmetics, and the like (see U.S. Pat. No. 4,190,918—Harvell); and a scarf which can be worn around a person's neck in the usual manner, but which has hand pockets at each end thereof so the person wearing it can hold the scarf above his head in an extended manner to use it as a pennant having words or phrases displayed thereon (see U.S. Pat. No. 4,037,340—Owensmith)

SUMMARY OF THE INVENTION

The present invention improves on these devices by providing a novel seat cushion which also serves as a pennant for cheering purposes, and with which different commonly available bumper-stickers or like objects displaying team names, symbols, mascots, etc., may be used without the need for different cushions for different terms.

According to the present invention a combination portable stadium cushion and pennant comprises a cushion having a message display area formed by an inverted substantially U-shaped member which is fixed on both sides of the cushion. Bumper stickers or like objects displaying information about a team may be used in the message display area so that the cushion then can be used as a pennant.

In another preferred embodiment, the present invention further comprises an extendible portion so that the cushion pennant outline resembles a hand with the forefinger extended in the traditional "Number One" position.

In both embodiments, the cushion also preferably has terms such as "Number One"or "#1" printed on the sides thereof.

BRIEF DESCRIPTION OF THE DRAWINGS

The details and advantages of the present invention will become more apparent from a careful consideration of the following detailed description of the invention in conjunction with the accompanying drawings, in which.

DETAILED DESCRIPTION OF THE PREFERRED EMBODIMENTS

Figure 1:
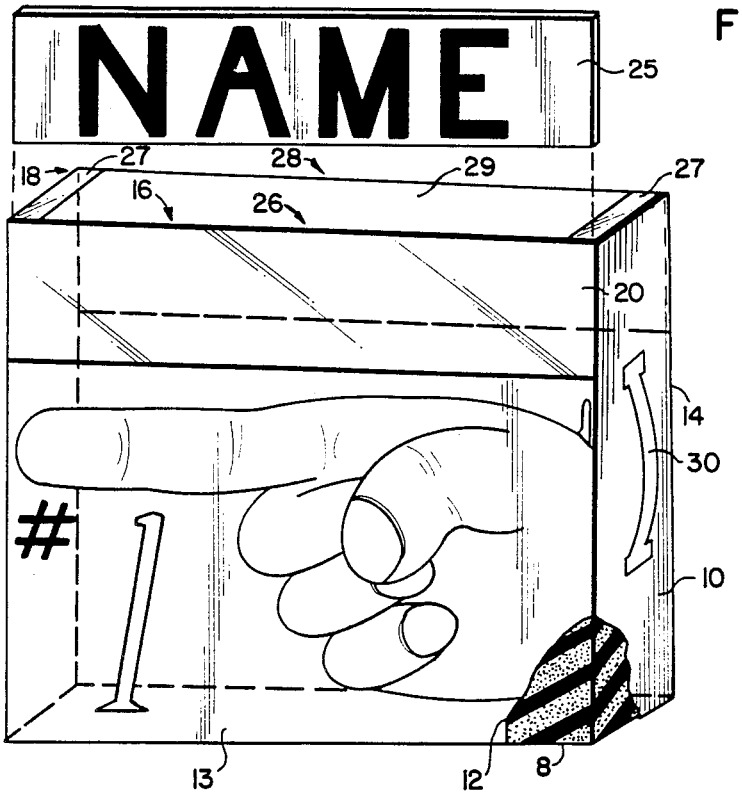
FIG. 1 is a part-sectional perspective view of a first preferred embodiment of the present invention shown with a bumper-sticker displaying information about a team about to be inserted in a pocket on a top portion thereof.

FIG. 1 illustrates a first preferred embodiment of a combination portable stadium cushion and pennant including a cushion 10 with a message displaying member 20 attached to a top edge and both sides of the cushion 10. The cushion 10 preferably has a handle 30 so that it can be carried and waved overhead easily.

The cushion 10 can be formed by a block of foam material 8 such as foam rubber, foam plastic, or other comparable material, which is enclosed within an outer cushion cover 12 made of flexible sheet material such as vinyl, plastic, leather, or other types of flexible sheet material conventionally used by one skilled in the art.

Figure 2:
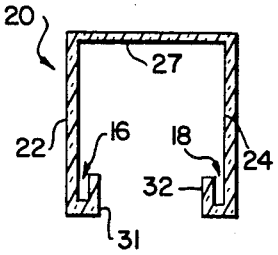
FIG. 2 is a cross-section of the inverted U-shaped message displaying member.

The message displaying member 20 is made of transparent plastic or other comparable material. As shown in FIG. 2, the message bearing member 20 is in a substantially inverted U-shape and includes front and back panels 22, 24. The panels 22 and 24 include inside folds 31, 32, respectively. As shown in FIG. 1, the member 20 is placed onto the top edge 29 of the cushion, and then heat-sealed, glued, stiched or otherwise attached to the cushion cover 12 at the sides, edges and corners of the U-shaped member 20 to create front and back pockets 16 and 18, respectively. The top strips 27 of the U-shaped display member can be formed as shown by small strips near the ends of the cushion top edge 29, with the remainder of the top edge 29 left uncovered, or be made of a single piece running the entire length of the top edge 29. In either case, the message displaying member 20 has openings on its top edges 26, 28 so that a bumper-sticker 25 or like objects displaying information about a team can be inserted into the pockets 16, 18 and held by inside folds 31, 32. The front and back panels 22, 24 of the message displaying member 20 are made of transparent plastic so that when a bumper-sticker is inserted therein the information about a team is visible.

The seat cushion comprises front and back sides 13, 14, respectively. Either or both of sides 13, 14 can be provided with an emblem 34, e.g., a closed human hand with the forefinger fully extended in the traditional "Number One" position, or a symbol such as "#1". It is to be understood that other display features may be provided on the front and back sides 13, 14 making the combination portable stadium cushion and pennant more attractive and conducive to sport events.

In use, the spectator may comfortably carry the combination portable stadium cushion and pennant, preferably with bumper-stickers 25 already inserted in the pockets 16, 18, by the handle 30 and use it on the bleachers or hard surfaces generally present in stadiums. The cushions then can be used as a pennant whenever appropriate during the course of a game, and as a seat cushion at other times.

Figure 3:
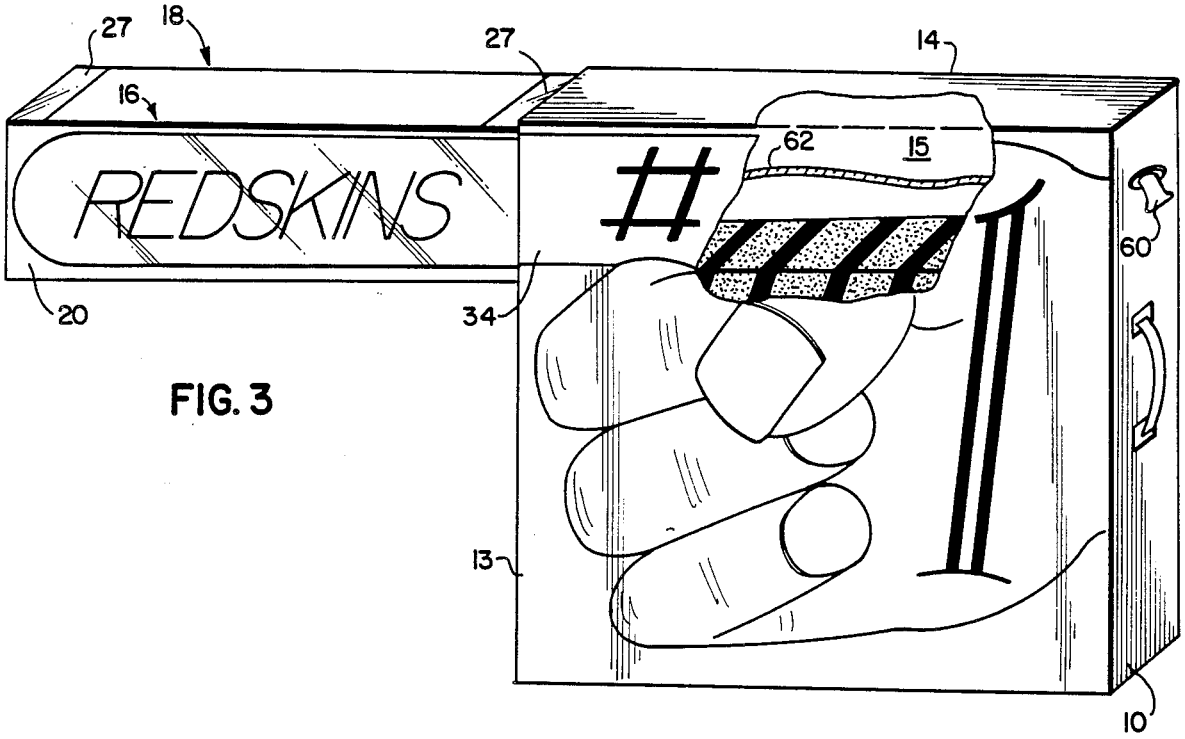
FIG. 3 is a part-sectional perspective view of a second preferred embodiment of the present invention.

In a second preferred embodiment shown in FIG. 3, the combination portable stadium cushion and pennant further comprises a rectangularly shaped extendible member 40, preferably foam filled, which is slidably disposed in a cavity 15 in the top portion of the cushion 10. The extendible member 40 can be pulled out of the cushion cavity 15 by a tab or the like (not shown) on its outer end and pulled back into the cavity 15 by a tab 60 and string 62 attached to its inner end.

In this embodiment, the message displaying member 20 preferably is mounted on or slidable onto the extendible member 40. The emblem 34 preferably comprises an emblem of a closed human hand with an extended forefinger, with the forefinger portion of the emblem 34 extending onto the extendible member 40 when it is extended fully out of the cushion 10.

Various modifications and alterations of the present invention will be readily apparent to persons skilled in the art. For example, multiple message displaying members 20 could be provided on a single cushion 10. It is intended, therefore, that the foregoing be considered as exemplary only and that the scope of the invention be limited only by the following claims.

What I claim is:

1. A combination portable stadium cushion and pennant, comprising:

cushion means for providing a cushioned seat;

a message display means mounted to a top part of said cushion means and comprising an inverted U-shaped member having a plurality of pockets formed in side walls thereof; wherein:

said inverted U-shaped member has openings into said pockets at top edges thereof;

said pockets are slightly larger than a bumper sticker-like means and made of a transparent material, so that said bumper sticker-like means can be recieved slidably and removably in said pockets with information on said bumper sticker-like means visible through said display means.

2. A combination portable stadium cushion and pennant as set forth in claim 1, further comprising an emblem of a closed human hand with a fully extended forefinger on at least one side thereof.

3. A combination portable stadium cushion and pennant as set forth in claim 1, further comprising a symbol "#1" on at least one side thereof.

4. A combination portable stadium cushion and pennant, comprising:

cushion means for providing a cushioned seat;

a substantially cylindrically shaped extendible member slidable in and out of a cavity in said cushion means near one side thereof; and message display means comprising an inverted U-shaped member mounted to said extendible member; wherein said inverted U-shaped member includes a plurality of pockets formed in side walls thereof and having openings into said pockets at top edges thereof; and said pockets are slightly larger than a bumper sticker-like means and made of a transparent material so that said bumper sticker-like means can be received slidably and removably in said pockets with information on said bumper sticker-like means visible through said display means.

5. A combination portable stadium cushion and pennant as set forth in claim 4, further comprising an emblem of a closed human hand with a fully extended forefinger extending onto said cylindrically shaped member on at least one side of said cushion.

6. A combination portable stadium cushion and pennant as set forth in claim 4, further comprising a symbol "#1" on at least one side thereof.

7. A combination portable stadium cushion and pennant as set forth in claim 4, further comprising tab means for pulling said cylindrically shaped member out of said cavity and tab and string means for pulling said extendible member into said cavity.

* * * * *